United States Patent [19]

Maya et al.

[11] Patent Number: 4,816,719

[45] Date of Patent: Mar. 28, 1989

[54] LOW PRESSURE ARC DISCHARGE TUBE WITH REDUCED BALLASTING REQUIREMENT

[75] Inventors: Jakob Maya; Rodomir Lagushenko, both of Brookline, Mass.

[73] Assignee: GTE Products Corporation, Danvers, Mass.

[21] Appl. No.: 678,959

[22] Filed: Dec. 6, 1984

[51] Int. Cl.[4] ..... H01J 61/02

[52] U.S. Cl. ..... 313/610; 313/611

[58] Field of Search ..... 313/609, 610, 611, 573, 313/634

[56] References Cited

U.S. PATENT DOCUMENTS

| | | | |
|---|---|---|---|
| 2,298,239 | 10/1942 | Strinkorb | 313/611 |
| 3,531,687 | 9/1970 | Greber | 315/309 |
| 3,848,150 | 11/1974 | Taxil et al. | 313/610 X |

*Primary Examiner*—Leo H. Boudreau
*Assistant Examiner*—K. Wieder
*Attorney, Agent, or Firm*—Carlo S. Bessone

[57] ABSTRACT

A low pressure arc discharge tube having structural means located within the envelope for causing a positive shift in the volt-ampere characteristic curve of the arc discharge tube. The shift in the volt-ampere curve causes a decrease in the impedance necessary to stabilize and ballast the discharge.

5 Claims, 2 Drawing Sheets

LOW PRESSURE ARC DISCHARGE TUBE WITH REDUCED BALLASTING REQUIREMENT

CROSS-REFERENCE TO RELATED APPLICATIONS

The application discloses subject matter related to that in U.S. Pat. No. 4,585,468; and U.S. Pat. No. 4,582,523, filed concurrently herewith, and assigned to the Assignee of this Application, but does not claim the inventions claimed in such related Applications.

BACKGROUND

This invention relates to low pressure arc discharge tubes and more particularly to such tubes which require a reduced amount of ballasting.

It is known in the art that arc discharge tubes have a negative volt-ampere characteristic. This characteristic necessitates the use of a ballast in order to limit the amount of current through the tube. The ballast adds, for example, additional weight, heat and cost to the lighting source.

It is highly desirable, therefore, to have a less negative volt-ampere characteristic so as to eliminate or at least reduce the ballasting requirements.

BRIEF SUMMARY OF THE DISCLOSURE

It is therefore, an object of this invention to obviate the disadvantages of the prior art.

It is another object of the invention to provide a low pressure arc discharge tube which requires a reduced amount of ballasting.

These objects are accomplished, in one aspect of the invention, by the provision of a low pressure arc discharge tube having an envelope of elongate, substantially cylindrical shape and having an electrode located at each end of the envelope. The envelope encloses an inert starting gas and a quantity of mercury. Included within the arc tube are structural means for causing a positive shift in the slope of the volt-ampere characteristic curve of the arc discharge tube.

DETAILED DESCRIPTION OF THE PREFERRED EMBODIMENTS

For a better understanding of the present invention, together with other and further objects, advantages, and capabilities thereof, reference is made to the following disclosure and appended claims taken in conjunction with the above described drawings.

Figure 1:
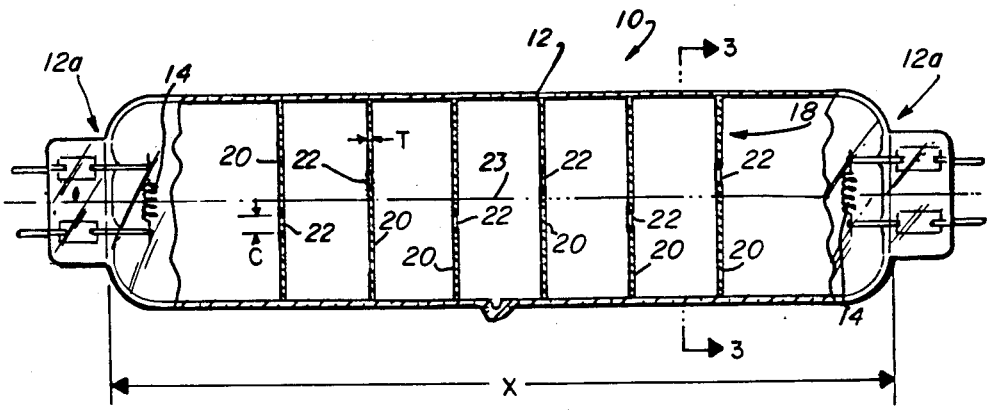
FIG. 1 is an elevational view, partly broken away of an arc discharge tube made in accordance with the invention.
Figure 2:
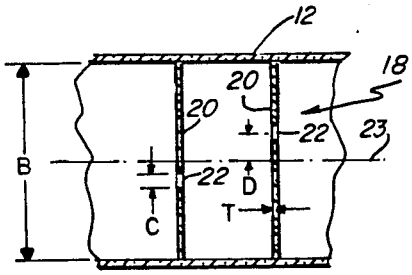
FIG. 2 is a partial cross-sectional view of the arc discharge tube of FIG. 1.
Figure 3:
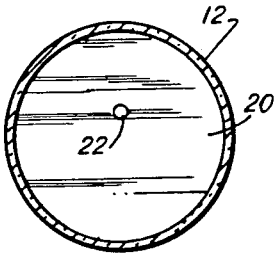
FIG. 3 is a cross-sectional view as taken along the line 3—3 in FIG. 1.

Referring now to the drawings with greater particularly, FIG. 1 shows an arc discharge tube 10 according to a preferred embodiment of the invention. The arc discharge tube 10 includes an envelope 12 of substantially cylindrical shape which is generally made of light-transmitting soda-lime, lead, quartz or other suitable material. An electrode 14 is located within each of the two axially opposed end portions 12a of the envelope. The envelop encloses an ionizable medium including a quantity of mercury and an inert starting gas, e.g. neon at a low pressure in the range of about 0.5 to 4 torr. Structural means 18 of quartz, glass, ceramic or other suitable electrically insulating material sufficient to cause a positive shift in the volt-ampere characteristic curve across the arc discharge tube 10 are incorporated within envelope 12. As shown in FIGS. 1–3 structural means 18 comprise a plurality of axially spaced apart partitions 20 each having at least one aperture 22 therein. Each of the partitions extends across the envelope 12 substantially normal to the longitudinal axis 23 and has a thickness T.

For best results T has a dimension less than the electron energy relaxation distance $d_r$ of the discharge tube. The electron energy relaxation distance is defined by the equation:

$$d_r^{-1}=[(3P_{Hg}Q_{in}^{Hg}+3P_RQ_{in}^R)(P_{Hg}Q^{Hg}+P_RQ^R)]^{\frac{1}{2}}$$

where $P_{Hg}$ is the mercury number density in the vapor $P_R$ is the rare gas number density $Q_{in}^{Hg}$ is the total inelastic scattering cross-section for the electrons by Hg.

$Q_{in}^{R}$ is the total inelastic scattering cross-section for the electrons by gas $Q^{Hg}$ is the total scattering cross-section for electrons by Hg.

$Q^R$ is the total scattering cross-section for electrons by gas.

Each of the partitions 20 contains at least one aperture 22 which constricts the arc within the tube anc causes an increase in the voltage across the arc discharge tube. Aperture 22 having a diameter C can be located at the center of the partition 20 or eccentrically located in the partition as in FIGS. 1–3. Locating the aperture 22 remote from the center of the partition 20, and having the apertures 22 of adjacent partitions 20 positioned in non-alignment provides the added advantage of increasing the effective arc length of the tube. The maximum effective arc length is achieved if the apertures 22 are also located alternatingly about the longitudinal axis 23 of the arc tube and if the apertures intersect a common plane passing through the longitudinal axis 23.

The partitions 20 may be sealed hermetically to the interior surface of envelope 12. However, an hermetic seal is unnecessary if the total area between the perimeter of each partition 20 and the interior surface of the envelope 12 is less than the area of aperture 22. The forming of the end portions 12a and the sealing of the electrode 14 leadwires can be performed after the partitions 20 are installed.

The voltage developed by each partition 20 is inversely proportional to the size of the aperture 22. An increase in voltage can be achieved when the ratio of the internal diameter B of the envelope 12 to the aperture 22 diameter C is as small as approximately 1.1:1. For maximum voltage increase, the aperture 22 diameter C should be made small enough to achieve a ratio B:C of approximately 50:1. Voltage increases of from about 0.5 volts to about 20 volts per partition can be achieved depending on the ratio B:C.

Arc discharge tubes normally have a negative volt-ampere characteristic in their arc discharge region of operation i.e., the arc voltage decreases for increasing current. This characteristic is represented on a graph of voltage vs. current by a curve having a negative slope. Any positive shift in the slope of the volt-ampere characteristic curve of an arc discharge represents a decrease in the amount of ballasting required to maintain a stabilized discharge.

It has been found that if the total voltage developed by the apertured partitions is less than or equal to the cathode fall (i.e., the voltage drop in front of the cathode), then the arc tube will have a negative volt-ampere characteristic (i.e., negative slope in which the voltage decreases for increasing current) or a relatively flat volt-ampere characteristic (i.e., voltage constant for increasing current). The cathode fall voltage is dependent on the fill gas and the properties of the cathode surface. However, greater than about 10 percent increase in the voltage across the arc tube as a result of the apertured partitions will result in a shift in the volt-ampere characteristic in the positive direction. This greater than about 10 percent increase in the voltage can be obtained by either increasing the number of partitions or decreasing the aperture diameter C. The resultant volt-ampere shift causes a decrease in the impedance necessary to stabilize and ballast the discharge.

It has been observed that by increasing the number of partitions and decreasing the diameter of the apertures, a positive volt-ampere characteristic can be generated if the total voltage developed by the apertured partitions is greater than the cathode fall. This phenomenon will be shown more fully with reference to an example and to the drawings in FIGS. 1–4.

Three arc discharge tubes were constructed from quarts having an envelope 12 wall thickness of about 1 mm, a length X equal to about 90 mm and an outside diameter of about 25 mm.

Arc tubes 1 and 2 were made with six quartz partitions, 20, each having a thickness T equal to about 1 mm. The partitions 20 were equally spaced apart from each other by about 10 mm. The distance from either electrode 14 to an adjacent partition 20 was also about 10 mm.

Each of the six partitions 20 included an aperture 22 having a diameter C of about 0.5 mm. This resulted in a ratio B:C of 50:1. The apertures were located alternatingly about the longitudinal axis 23 of the arc tube. The distance D from the longitudinal axis 23 to the midpoint of each aperture 22 was about 2 mm. The apertures 22 also intersect a common plane passing through the longitudinal axis 23 of arc tube 10 (e.g., the plane of the drawings of FIG. 1). Arc tubes 1 and 2 contained a fill gas of 100 percent neon at a pressure of 0.5 torr and 2.0 torr, respectively.

A third arc tube was constructed with the same dimensions as in tubes 1 and 2 but was constructed without the apertured partitions. This tube served as a reference or control. The fill gas and pressure was the same as tube 2 (i.e. 100 percent neon at a presusre of 2.0 torr).

Figure 4:
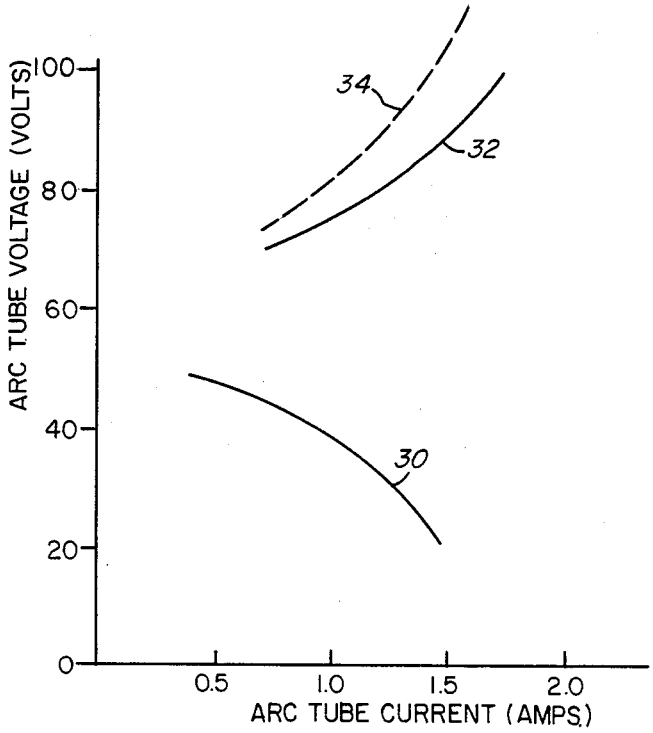
FIG. 4 is a graph showing typical volt-ampere characteristic curves of arc tubes made in accordance with the invention along with a control arc tube.

The volt-ampere characteristic curves of FIG. 4 are plotted for arc tubes 1, 2 and 3 on the basis of arc tube current measured in amps as abscissa and arc tube voltage measured in volts as ordinate.

Solid line curve 30 in FIG. 4 represents the volt-ampere characteristic of control arc tube 3. It shows a typical negative slope, representative of a conventional arc discharge tube made without structural means according to the invention.

Solid line curve 32 illustrates the positive volt-ampere characteristic of arc tube 2 having the same pressure of 2.0 torr as the control tube (curve 30) but made with the six apertured partitions as previously described.

Dotted line curve 34 of arc tube 1 shows the effect of reducing the neon starting gas to 0.5 torr.

The present invention is not limited to use in a glow discharge of mercury-inert gas without a phosphor layer. For example, use of partitions according to the invention in a 14" T12 European fluorescent lamp could increase the voltage from 39 volts to 100 volts. This would cause the voltage across the ballast to drop from 180 volts to 120 volts and thereby reduce the ballast losses by 35%.

While there have been shown what are at present considered to be preferred embodiments of the invention, it will be apparent to those skilled in the art that various changes and modifications can be made herein without depating from the scope of the invention as defined by the appended claims.

We claim:

1. A low pressure arc discharge tube comprising:

an envelope having an elongated substantially cylindrical shape, said envelope having two axially opposed end portions;

first and second electrodes each located within a respective one of said axially opposed end portions;

an ionizable medium enclosed within said envelope including an inert starting gas and a quantity of mercury for producing a plasma discharge when a predetermined voltage is applied across said electrodes; and structural means located within said envelope including at least one partition having a thickness dimension T and extending substantially across said envelope in a direction substantially normal to the longitudinal axis of said envelope and having at least one aperture of a given diameter located therein, said structural means being sufficient to cause a positive shift in the slope of the volt-ampere characteristic of said low pressure arc discharge tube.

2. The low pressure arc discharge tube of claim 1 wherein said dimension T is less than the electron energy relaxation distance of said discharge tube.

3. The low pressure arc discharge tube of claim 2 wherein said structural means comprises a plurality of said apertured partitions axially spaced apart within said envelope.

4. The low pressure arc discharge tube of claim 3 wherein said envelope has an internal diameter and the ratio of said internal diameter to said aperture diameter is within a range to provide a voltage increase across said arc discharge tube of greater than about 10 percent.

5. The low pressure arc discharge tube of claim 3 wherein said arc discharge tube has a substantially positive volt-ampere characteristic.

* * * * *